United States Patent [19]

Reineman et al.

[11] 4,383,486

[45] May 17, 1983

[54] DESK FOR HANDICAPPED PERSONS

[75] Inventors: Richard G. Reineman, Newport Beach; Jean O. Reinecke, La Canada, Flintridge, both of Calif.

[73] Assignee: Rol-Fol Table, Inc., Van Nuys, Calif.

[21] Appl. No.: 173,114

[22] Filed: Jul. 28, 1980

[51] Int. Cl.[3] ..... A47F 5/12

[52] U.S. Cl. ..... 108/2; 108/6; 108/10

[58] Field of Search ..... 108/10, 6, 2, 9; 248/451, 454; 297/373

[56] References Cited

U.S. PATENT DOCUMENTS

| | | | |
|---|---|---|---|
| 538,712 | 5/1895 | Stuart | 248/451 X |
| 2,369,348 | 2/1945 | Gore | 248/451 |
| 3,012,363 | 12/1961 | Sautereau . | |
| 3,057,112 | 10/1962 | Bergman | 248/454 |
| 3,142,511 | 7/1964 | Rehel | 297/149 |
| 3,238,900 | 3/1966 | Janus | 108/9 |
| 3,359,927 | 12/1967 | Janus | 108/2 |
| 3,362,747 | 1/1968 | Fuelling et al. | 297/373 |
| 3,423,060 | 1/1969 | Fulling et al. . | |
| 3,493,211 | 2/1970 | Barecki et al. . | |
| 3,606,450 | 9/1971 | Sedgwick | 297/149 |
| 3,698,327 | 10/1972 | Litvinoff | 108/6 |
| 3,703,147 | 11/1972 | Sclander | 108/10 |
| 4,058,066 | 11/1977 | Altman | 108/10 |
| 4,248,161 | 2/1981 | Adair et al. | 297/373 |

FOREIGN PATENT DOCUMENTS

| | | | |
|---|---|---|---|
| 464622 | 1/1973 | Australia | 108/2 |
| 1207618 | 10/1970 | United Kingdom | 297/373 |

*Primary Examiner*—Francis K. Zugel

*Attorney, Agent, or Firm*—Knobbe, Martens

[57] ABSTRACT

The elevation and angle of a desk top are independently adjustable with the exertion of a minimum of manual force, thereby facilitating the use of the desk by handicapped or disabled persons. The desk is provided with a torsion bar to substantially ease elevational adjustments and with a parallel lever arm construction which permits such adjustments without changing the angle of the desk top. The height and tilt angle of the desk top are each securely fixed by means of a pair of serrated, interlocking discs which are spring loaded to permit them to be easily locked or unlocked with only a few turns of an adjustment handle. In addition, frictional washers are utilized in conjunction with this spring loading to substantially maintain the position of the desk top even after the discs are unlocked, further facilitating angular and elevational adjustments by persons of impaired physical strength. The desk is designed and suitably dimensioned to accommodate a wheel chair, and the desk top is provided with a removable clamp and a raised peripheral edge to prevent books, paper, writing utensils and the like from falling off.

25 Claims, 9 Drawing Figures

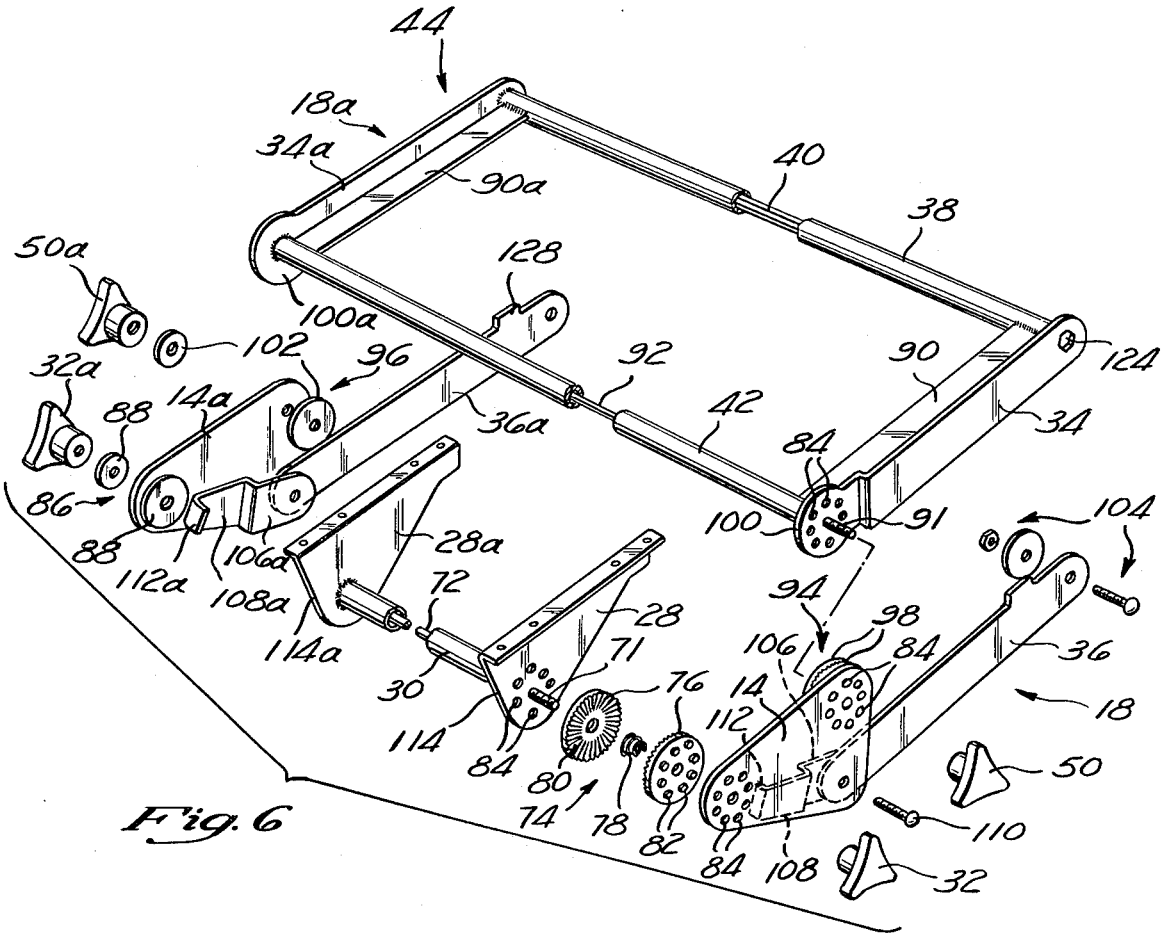
Fig. 6
Fig. 9
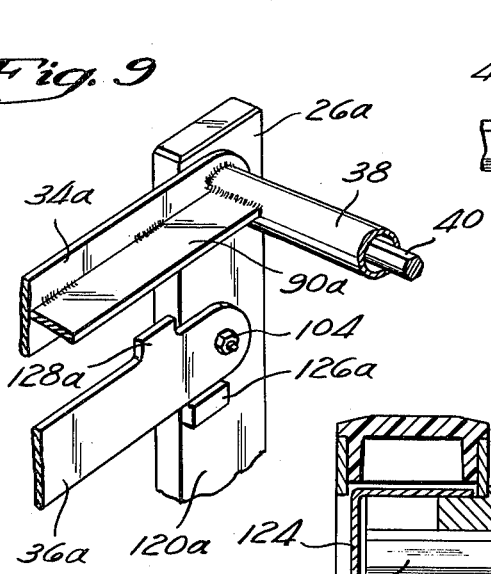
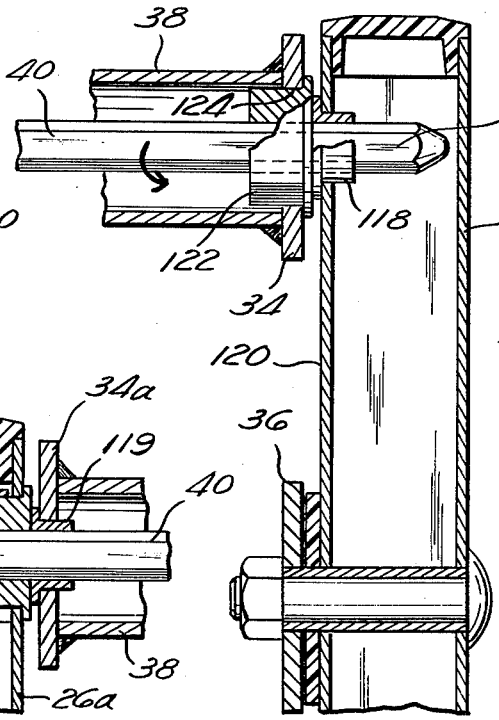
Fig. 7
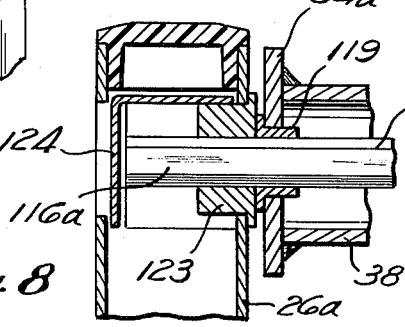
Fig. 8

DESK FOR HANDICAPPED PERSONS

BACKGROUND OF THE INVENTION

Until recently, it was common for mentally or physically incapacitated persons to be incarcerated in institutions, or otherwise separated from society, and subjected to treatment which would be considered inhumane by contemporary standards. Eventually, however, it was learned that many handicapped persons could make worthwhile contributions to society if given the mere opportunity to be educated and trained. With increasing frequency, laws have been enacted and funds appropriated expressly for these purposes.

Such education and training invariably requires the use of a desk or table. However, desks designed and constructed for use by non-handicapped persons, and especially desks having adjustable desk tops, usually fail to meet the physical needs to a handicapped person and therefore impair or prevent his or her educational progress. For example, both mentally and physically disabled persons commonly have only the weakened and limited use of their extremities and are often confined in a wheel chair or other supportive seating device. Furthermore, handicapped persons may have the use of only one hand or arm (which is usually capable of exerting only minimal physical force) and may have little or no manual dexterity. As a result, it is typically impossible for such persons to adjust or otherwise utilize a desk designed for persons blessed with full mental and physical capacity. In addition, such desks are usually insufficiently dimensioned so that they do not accomodate a wheel chair or other seating device commonly used by handicapped persons.

Prior art desks specially designed for handicapped persons have also failed to meet the physical needs of the disabled. Typically, desks of the prior art have been adapted to be mounted on wheel chairs as shown in U.S. Pat. No. 3,606,450 to Sedgwich and No. 3,142,511 to Rehel. The mere mounting of such prior desks, however, precludes their independent use by most handicapped persons. Furthermore, adjustments to the height or angle of such prior desks require either two hands or substantial manual strength or dexterity, preventing the unassisted use of such prior desks by handicapped persons.

By failing to meet the physical needs of handicapped and disabled persons, prior desks have also failed to meet important mental and emotional needs. That is, as with non-handicapped persons, the accomplishments of a handicapped person are closely related to feelings of self worth and independence; in short, his ability to fend for himself. Thus, the use of these prior desks, by requiring the assistance of another person, may significantly impair a handicapped person's emotional progress and unnecessarily limit his potential contribution to society. At the same time, the accomplishments of the person required to assist a handicapped person in using such prior art desks are also severly limited.

Therefore, there remains a need for a desk which can be utilized by a handicapped person without the need for assistance by another person.

SUMMARY OF THE INVENTION

The present invention relates to a desk for use by a handicapped or disabled person whose top can be adjusted by the exertion of a minimum of manual force and dexterity. The desk is provided with a torsion bar system which greatly facilitates adjustments in the height or elevation of the desk top since it minimizes the amount of physical strength required to lift the desk top. Furthermore, the torsion bar is mounted on the desk so as to approximately neutralize the force of gravity acting on the desk top. Therefore, the torsion bar serves as a spring or suspension device which prevents the desk top from simply falling quickly to its lowest position. Thus, only minimal manual force is required to lower the desk top, and, in addition, the torsion bar provides for smooth, easy control in adjusting the desk top in both vertical directions.

A significant feature of the present invention is that the height of the desk top can be adjusted without changing its angle or slant. In the preferred embodiment, a parallel lever arm construction permits the angle of the desk top to be adjusted independently from its elevation, thus reducing the total number of adjustments necessary. Furthermore, a wide range of both elevational and angular positions are possible in the desk of the present invention, providing utilization of the present desk by persons of varied stature, by persons who may be either sitting or standing, and by persons engaged in a variety of activities, such as reading, writing, drawing, etc.

Another important feature of the present invention is that two pair of interlocking discs are used to fix or lock the position of the desk top after the desired adjustments are affected. Thus, in the preferred embodiment, one pair of interlocking discs prevents changes in the elevation of the desk top while a second pair of interlocking discs prevents angular movements of the desk top. Each pair of discs are juxtaposed and their adjacent surfaces have serrations which, when engaged, prevent the rotation of one disc relative to another to securely maintain the position of the desk top. The interlocking discs are operable from either side of the desk by means of a pair of handles which are conveniently located close to one another and near the rear of the desk. Advantageously, only a few easy turns of these handles are required to selectively either engage the interlocking discs to lock the position of the desk top, or to disengage them to permit adjustment in its position. In addition, the discs are spring loaded to greatly facilitate their separation and permit adjustments in the position of the desk top. Furthermore, the desk of the present invention is provided with frictional washers which are utilized to substantially prevent both the elevational and angular movement of the desk top. Significantly, the operation of these washers is assisted by the spring loading of the interlocking discs, so that when the discs are disengaged the frictional holding force of the washers is increased, thereby facilitating adjustments in the position of the desk top.

Thus, the desk of the present invention enjoys several significant advantages which make it particularly suited for use by handicapped or disabled persons or other persons with less than average physical strength and manual dexterity. For example, when it is desired to change the position of the desk top, the interlocking discs can be disengaged by the handles located on either side of the desk. This is an important feature since, as mentioned above, a handicapped person often has the use of only a single arm or hand. Furthermore, these handles which permit both height and angular adjustments, are located close to one another and near the rear of the desk, thus providing easy accessability for a handicapped person whose ability to move or extend an arm may be severely impaired. Moreover, the need for manual dexterity is greatly reduced since disengagement of the interlocking discs can be accomplished with only a few turns of the handle, being substantially aided therein by the compression springs mounted between the discs.

Once the discs are unlocked, the position of the desk top is advantageously maintained by the frictional washers which prevent it from abruptly falling by the force of gravity to its lowest angular or elevational position. Furthermore, with respect to elevational adjustments, the suspension characteristics of the torsion bar also aid in maintaining the position of the desk top even though the interlocking discs are disengaged. As a result, no physical strength is required to hold or steady the desk top during or after disengagement of the interlocking discs. After disengagement, the desk top can be adjusted to the desired position, again remaining in the new position by means of the frictional washers and the torsion bar, as just explained, while the handles are turned just a few turns to securely lock the desk top in that position. Furthermore, elevational adjustments in the desk top are greatly facilitated by the torsion bar; in fact, only the force exertable by the finger tips is generally sufficient to move the desk top either up or down.

Thus, the torsion bar, the spring loaded interlocking discs, and the frictional washers, all cooperate in a novel manner to minimize the strength, force, and dexterity required to adjust the position of the desk top of the present invention. Therefore, the present desk can generally be utilized by persons having only the weakened, limited use of a single arm or hand.

There are other features of the present invention which make it particularly suitable for use by handicapped or disabled persons. For example, the base of the desk is dimensioned to accommodate a wheel chair or other similar supportive seating device in which a handicapped person may be confined. The base is also provided with sufficient clearance and is void of any obstructions, such as cross bars, beneath the desk which would impede the positioning of the wheel chair behind the desk by its operator. Furthermore, the base of the present desk is heavy and sturdy so as to provide substantial resistance to tipping. This is an important feature since a person seated in a wheel chair will oftentimes bump the desk or make other incidental contact with the desk while positioning himself behind it.

Furthermore, the present desk is advantageously provided with a removeable clamp which can be attached either at the top or the bottom of the desk to hold books and papers, etc. Similarly, the periphery of the desk includes a raised lip which will contain such materials on the desk top and prevent them from falling to the floor. These are also important features since it is difficult or impossible for a handicapped person to retrieve papers, books, writing utensils, and the like, if they should fall off of the desk top.

Thus, the desk of the present invention can be easily adjusted and otherwise utilized by a handicapped person without requiring the assistance of another person. Furthermore, although the present desk is particularly suited for handicapped and disabled persons, it can also be advantageously utilized by anyone including artists, draftsmen, and engineers and will be particularly appreciated by persons of less than average strength.

DESCRIPTION OF THE DRAWINGS

FIG. 6 is an exploded, perspective view of the height and angle rotational assemblies of the present desk;

FIG. 7 is a cross sectional view taken along line 7—7 of FIG. 3 illustrating the manner in which the right end of the torsion bar of the present invention is mounted on the base of the desk;

FIG. 8 is also a cross sectional view illustrating the mounting of the left end of the torsion bar; and FIG. 9 is a perspective view of the safety devices mounted on the parallel lever arms which limit the movement of the desk top in order to prevent injury to its user.

DETAILED DESCRIPTION OF THE INVENTION

General Construction

Figure 1:
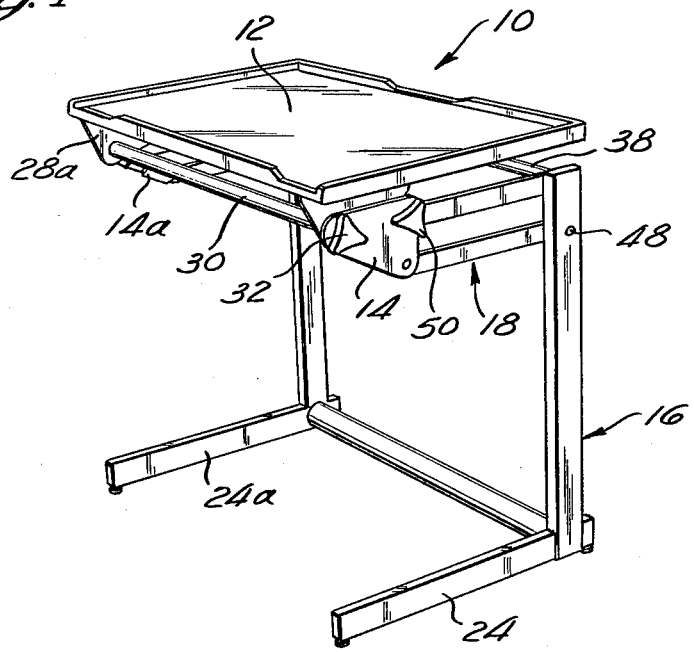
FIG. 1 is a perspective view of the desk of the present invention illustrating its desk top in its lowest elevational and angular positions.
Figure 2:
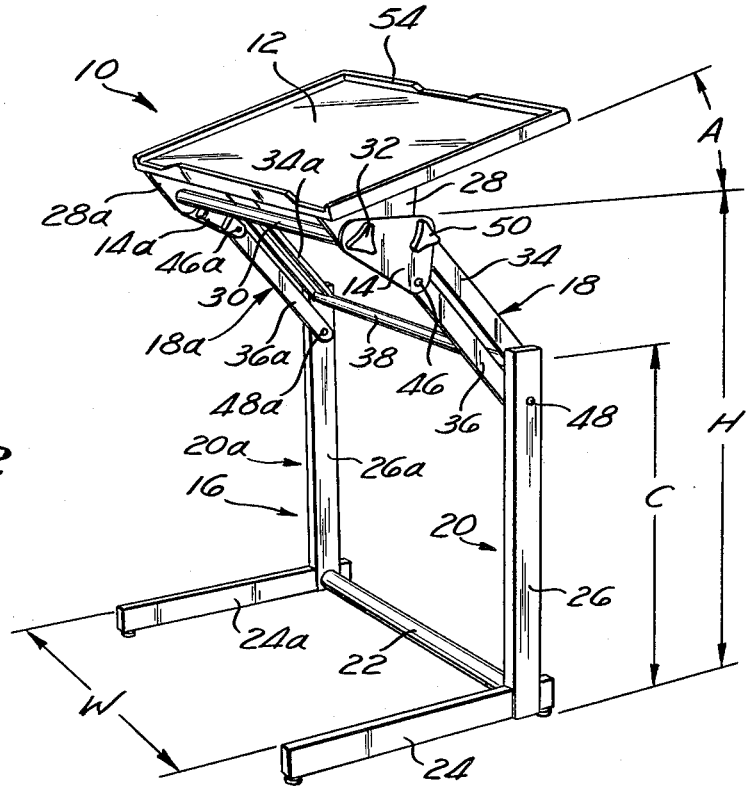
FIG. 2 is another perspective view of the present desk illustrating the manner in which the position of the desk top can be adjusted.

As shown in FIGS. 1 and 2, the desk 10 of the present invention in its preferred embodiment includes a large desk top 12 rotatively mounted between a pair of side plates 14 and **14*a* located on either side of the desk. The desk 10 also comprises a sturdy base 16 to support the desk top 12 and two pair of parallel lever arms 18 and 18*a* disposed on either side of the desk 10 so as to be rotatively interconnected between the side plates 14 and 14*a* and the upper portion of the base 16. Thus, as shown in FIG. 2, the rotational mounting of the desk top 12 upon the side plates 14 and 14*a* permits the angle A of the desk top 12 to be adjustable with respect to the horizontal, and the rotational connections at each end of the parallel lever arms 18 and 18*a* permits the height H of the desk top 12** to also be adjustable independent of the angle A.

The base 16 of the desk 10 is comprised of two rearwardly facing, L-shaped members 20 and **20*a* which are interconnected at their lower, forward portions by a cross bar 22. Each L-shaped member 20 is comprised of a horizontal leg 24 and a vertical upright member 26 which supports the forward ends of one of the parallel lever arms 18**.

This base 16 is designed and constructed to facilitate the use of the present desk 10 by handicapped and disabled persons. For example, the width of the desk is sufficient to accomodate wheel chairs or other supportive seating devices in which such handicapped persons may be confined. As merely one example, it has been found that a width W of thirty inches is sufficient to accomodate virtually all sizes of wheel chairs. Furthermore, the cross bar 22 connecting the two L-shaped members 20 and **20*a* is disposed at the extreme forward portion of the desk so that there are no lateral obstructions behind that point. Therefore, there is nothing to inhibit a wheel chair from being positioned snugly behind the desk 10** to facilitate its use by a person in a wheel chair.

To further accomodate wheel chairs, the upright members 26 and 26*a* of the base 16 are sufficiently tall so that there are no upper lateral obstructions which could hinder the use of the desk 10 by a handicapped person. Thus, it has been found that a vertical clearance C of twenty-five inches is sufficient to provide for these advantages, including the ability to accomodate a person whose legs must remain horizontal, rather than being bent at the knee. Furthermore, if additional clearance is desired or necessary, one need only increase the length of the upright members 26 and 26*a*. Moreover, the base 16 is extremely sturdy and strong so as to prevent the desk 10 from tipping or falling and possibly injuring a user. This feature enables a person in a wheel chair to make incidental contact with the desk while positioning himself behind it (regardless of the position of the desk top), without fearing that the desk will tip over. Furthermore, the sturdy base 16 of the present invention permits the desk top 12 to be very large and adjustable to a wide variety of positions, while still maintaining the stability of the desk.

Adjustability of the Desk Top

As shown in FIG. 2, the desk top 12 is mounted on a pair of support plates 28 and 28*a* which are connected by a hollow tube 30. As will be explained in more detail in connection with FIG. 6, these support plates 28 and 28*a* and tube 30 provide the means for rotationally mounting the desk top 12 between the side plates 14 and 14*a* and for adjustably maintaining its angular position. These adjustments are made possible by a handle 32 mounted on the side plate 14 which is used to either securely fix the desk top 12 at the desired angular position or to unlock it to permit adjustments in its angle. A similar handle 32*a* is located on the opposite side of the desk 10 so that the angle of the desk top 12 is adjustable from either side. Furthermore, as shown in FIG. 2, these handles 32 are conveniently located near the rear of the desk 10 to provide easy accessability.

Each pair of parallel lever arms 18 is comprised of an upper arm 34 and a lower arm 36. The upper arms 34 and 34*a*, as shown in FIG. 2, are connected at their forward end by a hollow tube 38 which contains a hexagonal torsion bar 40 (shown in FIG. 6) to facilitate adjustments in the height or elevation of the desk top 12, as will be explained in more detail in connection with FIGS. 7 and 8. The rear ends of the upper lever arms 34 and 34*a* are also connected by a hollow tube 42, also shown in FIG. 6, so that the upper arms 34 and 34*a* and the tubes 38 and 42 form a rectangular frame structure 44.

Referring again to FIG. 2, the lower arms 36 and 36*a* are rotatively mounted to the side plate 14 and 14*a* and to the upright member 26 and 26*a*, respectively, as indicated generally at 46 and 46*a*, and 48 and 48*a*. As explained hereinafter, the elevation of the desk top 12 is adjustable by means of handles 50 and 50*a* mounted on the side plates 14 and 14*a* on either side of the desk 10.

Figure 3:
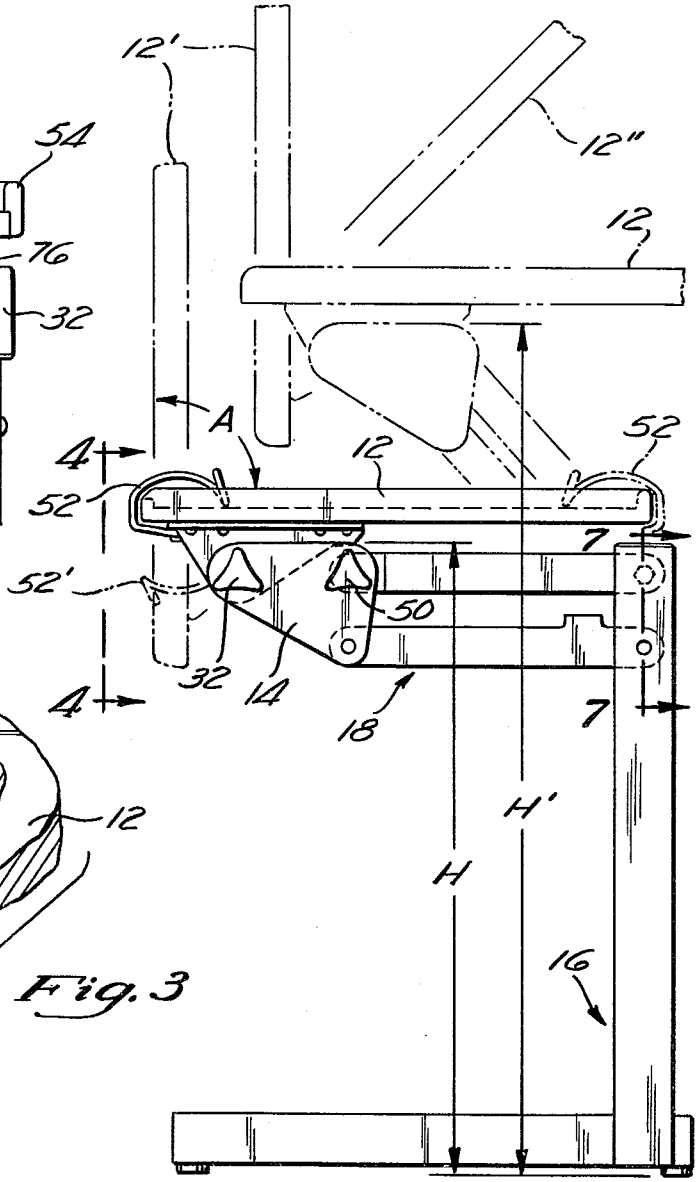
FIG. 3 is a side view of the present desk, again illustrating the various possible elevational and angular positions of the desk top.

Thus, this parallel lever arm construction provides several significant advantages to the desk ot the present invention. For example, as illustrated in FIG. 3, the height or elevation A of the desk top 12 is adjustable within a wide range of positions. As merely one example, for lever arms 18 approximately 12 inches long, the elevation of the desk top 12 can be increased as much as nine inches, ranging from a minimum height H of about 27 inches to a maximum height H' of about 36 inches.

As the height of the desk top 12 is adjusted, the parallel lever arms 18 and 18*a* maintain its original angular orientation. That is, as shown in FIG. 3, if the desk top 12 is originally in a horizontal position, it will be maintained in that position as its height H is increased to its maximum position H'. This feature, therefore, facilitates the use of the present desk by a person of less than average physical strength and/or impaired manual dexterity, since the total number of adjustments is reduced.

For example, if it is desired to increase the height H of the desk top 12, without changing its angle A, this can be easily accomplished by means of the handle 50 acting in cooperation with the parallel lever arms 18 and 18*a*, as explained above. There is no need to manipulate the handle 32 in order to readjust the angular position of the desk top. Furthermore, employing two parallel lever arms 18 and 18*a* permits the height of the desk 10 to be fixed by the handle 50 located at the rear end of the lever arms 18 and 18*a*, rather than only at their forward end where they pivot about the upright members 26 and 26*a*. Thus, the handle 50 can be conveniently located on the side plate 14, near the handle 32 for effecting angular adjustments of the desk. Therefore, handicapped or disabled persons utilizing the present desk are required to make as few adjustments as possible and to exert a minimum amount of physical force.

As shown in FIG. 3, the angle A of the desk top 12 is adjustable (by utilizing the handle 32) to an infinite number of positions within a 90° range, including a horizontal position 12, a vertical position 12', or any angular position 12''. In addition, as with height adjustments, the angle A of the desk top 12 can be adjusted independently, without changing its height H.

Removable Book Clamp

Figure 4:
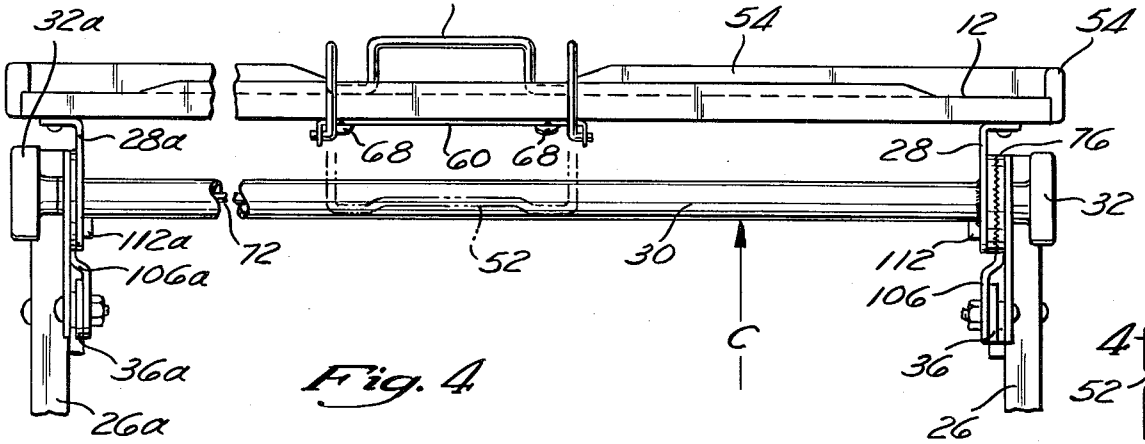
FIG. 4 is a cross sectional, front elevational view of the upper portion of the present desk taken along lines 4—4 of FIG. 3.
Figure 5:
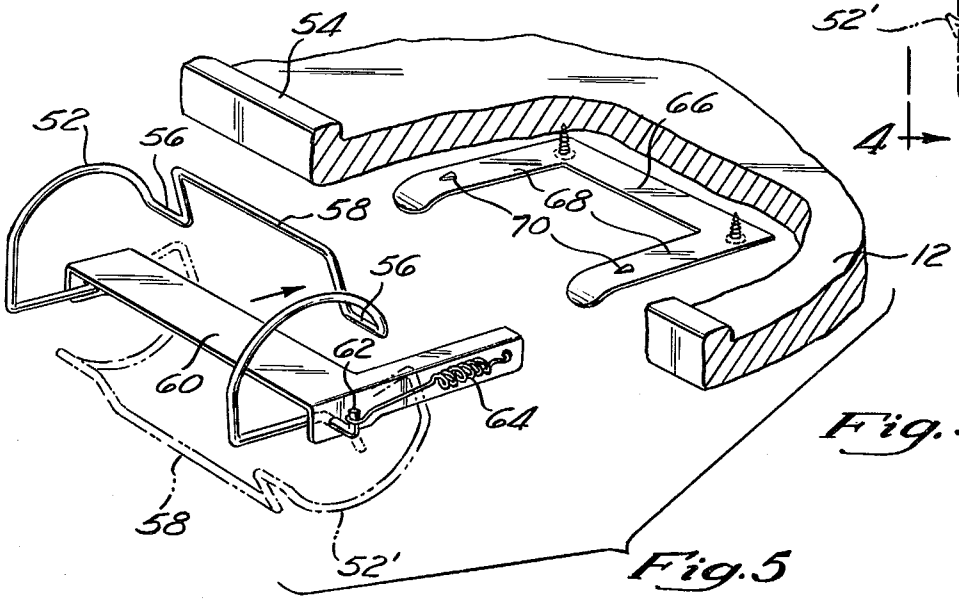
FIG. 5 is a perspective view of the detachable clamp utilized in connection with the present invention.

FIGS. 3 through 5 illustrate a retractable, removable clamp 52 for holding books and papers on the upper surface of the desk top 12. For example, as shown in FIG. 3, the clamp can be mounted at the rear or at the front of the desk top 12, providing means for securing virtually all sizes of papers and books in the most convenient fashion. Furthermore, in either the front or rear location, the clamp 52 is retractable, if desired, by simply rotating it through approximately 180° until it comes to rest underneath the desk top 12, as shown at 52'. This clamp device 52 offers a significant advantage to a handicapped user of the present desk since many handicapped or disabled persons are unable to hold papers with one hand while writing or drawing with the other. Thus, this clamp 52 eliminates the need for both hands and permits the desk 10 to be more conveniently utilized by a person having the use of only a single hand or arm. Furthermore, because of the impaired dexterity of many handicapped persons, they are not able to handle books and papers well. Therefore, the clamp device 52 prevents such objects from falling off of the desk top 12 and thus eliminates the physical problem of retrieval. In this regard, the periphery of the desk top 12 is also provided with a raised lip 54, best illustrated in FIG. 2, which also prevents books, papers, writing utensils, and the like, from falling off of the desk top.

As illustrated in FIG. 4, even in the retracted position 52', this clamp device 52 does not reduce the vertical clearance C of the present desk. Nevertheless, if the maximum amount of vertical clearance at the rear of the desk is desired, the clamp device 52 can be simply removed from that position and attached at the front of the desk, as shown in FIG. 3, or not attached at all to the desk.

FIG. 5 illustrates the detailed construction of this removable, retractable clamp device 52. The clamp itself is constructed from a bent material, such as a rigid wire, and is provided with lower end portions 56 to hold objects on the desk top 12 and a raised middle portion 58 which serves as a handle. The clamp is rotatively mounted in suitable openings in an L-shaped frame 60 and is provided with an extending arm 62 at one side which is attached to one end of a spring 64. The spring 64, in turn, is attached to its opposite end to the L-shaped frame 60. The frame 60 is then slidably engaged over a rearwardly facing, U-shaped bracket 66 which is attached to the lower surface of the desk top 12 and serves to securely mount the frame 60. The extending fingers 68 of the bracket 66 are curved slightly downward to facilitate the sliding of the frame 60 between the bracket 66 and the lower side of the desk top 12 and are provided with catches 70 which prevent the frame 60 from being disengaged from the bracket 66. To remove the frame 60 and the clamp device 56 from the bracket 66, the fingers 68 are simply flexed downwardly a slight amount in order to permit the frame 60 to pass over these catches 70. A similar, forwardly facing bracket (not shown) is attached to the underside of the desk top 12 near its front to provide means for mounting the clamp device 52 at that location, as shown in FIG. 3.

In operation, the lower holding portions 56 of the clamp are held firmly against the desk top 12 by means of the spring 64 which exerts a retentive force on the extending arm 62. Thus, books, papers, and other objects are securely held on the desk top 12 by the clamp 52. Furthermore, because the arm 62 is substantially vertical in both the holding and retracted positions, a similar retentive force is applied to the clamp 52 by the spring 64 when it is in a retracted position 52', as shown in FIG. 5. Therefore, the clamp 52 will remain securely in the retracted position and any tendency to fall down will be resisted by the spring 64.

Locking Means for Angular Adjustment of the Desk Top

The exploded view of FIG. 6 illustrates in detail the rotational mounting on the side plates 14 and **14*a* of the desk top 12 and of the parallel lever arms 18 and 18*a*, in order to provide the angular and elevational adjustments, respectively, for the desk of the present invention. FIG. 6 further illustrates the manner in which the desk top 12** can be fixed or locked in the desired position.

As explained above, the desk top 12 is mounted on a pair of support plates 28 and **28*a* which are connected by a hollow tube 30. A locking rod 72, which provides the axis of rotation for adjusting the angle of the desk top 12, is inserted through this hollow tube 30 so that its threaded ends extend beyond the support plates 28 and 28*a*. The right end 71 of the locking rod 72 is inserted through a locking device 74, which serves to fix the angular position of the desk top 12, and extends through the side plate 14 whereupon it is received by the threaded handle 32**.

This locking device 74 is comprised of a pair of juxtaposed, interlocking discs 76 which are separated by a compression spring 78. When compressed, the spring 78 exerts about 20 pounds per square inch of force on the discs 76. The adjacent faces of these discs are serrated to form radial, interlocking teeth 80 which, when engaged, fix the angular position of the desk top 12. Preferably, these discs 76 are constructed from a strong, durable, polymer material, such as polycarbonate, and the serrations or teeth 80 are formed by a stamping process. The discs 76 are attached to the support plate 28 and to the side plate 14 by means of short mounting pegs 82 formed on the back of the discs. The pegs 82 are inserted through corresponding holes 84 in these plates 28 and 14 and are adhesively retained therein.

The juxtaposed discs 76 are engaged by turning the handle 32 just a few turns, e.g., less than one complete revolution, as shown in FIG. 4. When so engaged, the discs 76 prevent rotation of the desk top 12 and the support plates 28 and **28*a* relative to the side plates 14 and 14*a*, thereby locking the angular position of the desk top 12. That is, the teeth 80 of these interlocking discs 76 mesh together to prevent the rotational movement of the desk top 12, without requiring a great amount of physical strength. Similarly, a few turns of the handle 32 in the opposite direction will disengage the interlocking discs 76, being greatly aided by the spring 78 shown in FIG. 6. With the teeth 80 of the interlocking discs 76 thus separated, the angular position of the desk top 12 can be readjusted. Therefore, the use of the present desk by a handicapped or disabled person is greatly facilitated since only minimum force and dexterity is required to lock and unlock the angular position of the desk top 12**.

Holding Means for Angular Adjustment of the Dest Top

The actual adjustment of the desk top 12 is also facilitated by the manner in which it is rotatively mounted on the locking rod 72. That is, the left side of the locking rod 72 is provided with a holding device 86 for maintaining the position of the desk top 12 even after the interlocking discs 76 are disengaged. This holding device 86 is comprised of frictional washers 88 sandwiched around the left side plate **14*a*, as shown in FIG. 6, which inhibit the rotation of the desk top 12 and support plates 28 and 28*a* relative to the side plates 14 and 14*a*. At least one of these washers 88 bears against the support plate 28*a* and applies to it a frictional force which resists the rotation of the plate 28*a* in either direction, thus maintaining the position of the desk top 12. The magnitude of this holding frictional force can be varied depending upon the firmness with which the washers 88, the side plate 14*a*, and the support plate 28*a* press against one another. Thus, increasing or decreasing the number, size and thickness of washers 88 will vary the holding force. Preferably, only two washers 88 are utilized, but additional adjacent washers can be used if desired or necessary. Furthermore, although the rotational movement of the desk top 12 is inhibited by the operation of the washers 88, the frictional holding force they produce can be overcome when only slight manual force is applied, in order to permit the angular adjustment of the desk top 12. The washers 88** are constructed from any suitable frictional material, such as neoprene.

Furthermore, the compression spring 78 located between the interlocking discs 76 enhances the operation of the holding device 86. As can be seen from FIG. 4, when the interlocking discs 76 are disengaged, the spring 78 tends to force together the support plate **28*a*, side plate 14*a*, and handle 32*a* at the left side of the locking rod 72, thereby increasing the frictional forces serving to hold the desk top 12** in its present location.

Thus, in changing the slant or angle of the desk top 12, a handicapped person does not have to hold or support the desk top 12 with one hand while using the other to make the adjustment. Rather, only a single hand, and much less physical force, is necessary. For example, one hand can be utilized to turn the handles 32 or 32*a* to unlock the discs, and while the frictional washers 88 maintain the present position of the desk top 12, the same hand can be used to adjust it to the desired angular location. Finally, the same hand can be used to turn the handles 32 and 32*a* in order to lock the desk top 12 in the new position. Another important feature of the present invention is that either the right handle 32 or left handle 32*a* can be utilized to lock and unlock the desk top 12, facilitating the use of the present desk by either hand. Furthermore, the positions of the locking and holding devices 74 and 86, respectively, can be reversed if desired.

Locking and Holding Means for Elevational Adjustment of the Desk Top

FIG. 6 also illustrates in detail the rotational mounting of the upper lever arms 34 and 34*a*, and particularly the rectangular frame 44 which is comprised of the upper lever arms 34 and 34*a* and the hollow tubes 38 and 42. The lever arms 34 and 34*a* are strengthened by interior ribs 90 and 90*a* which extend between the tubes 38 and 42 interconnecting the respective ends of the lever arms 34 and 34*a*. A torsion bar 40 is inserted through the tube 38 and serves as an axis of rotation for the lever arms 34 and 34*a* as they rotate to change the height of the desk top 12. This torsion bar 40 also greatly facilitates such rotational movement, thereby assisting elevational adjustments, as will be described below in more detail.

The hollow tube 42 is provided with a threaded locking rod 92, the ends of which are equiped with locking and holding devices 94 and 96, respectively, similar to those described above with respect to the angular adjustment of the desk top 12. Thus, the right end 91 of the locking rod 92 is inserted through a pair of interlocking discs 98 sandwiched around a spring (not shown) and through the side plate 14 where it is fitted with a threaded handle 50. One of the discs 98 is attached to the side plate 14 by means of pegs (not shown) and mounting holes 84, in a manner similar to the discs 76. The other disc 98 is attached, also by means of holes 84, to a flange 100 at the rear end of the lever arm 34. Furthermore, the holding device 96, located at the left end of the locking rod 92, includes a pair of frictional washers 102, one of which engages a similar flange 100*a* at the rear end of lever arms 34*a*. Although the frictional washers 88 and 102 are shown to be on either side of the side plate 14*a*, they may be placed at other suitable locations along the locking rods 72 and 92 in order to accomplish their holding function.

Thus, when the interlocking discs 98 are engaged, as shown in FIG. 6, they prevent rotation of the lever arms 34 and 34*a* relative to the side plate 14 and 14*a* thereby serving to securely lock the desk top 12 in the desired elevational position. As before, these discs 98 are engaged or disengaged by only a few turns of either handle 50 or 50*a*, disengagement being facilitated by the compression spring between the interlocking discs 98. Also, the elevation of the desk top 12 is easily adjusted by means of the frictional washers 102 which cooperate with the torsion bar 40 to aid in this operation.

The lower lever arms 36 and 36*a* are rotatably mounted at their forward ends to the upright members 26 and 26*a* of the base 16 by means of a washer and nut assembly 104. The rear ends of the lever arms 36 and 36*a* are inserted into hinges 106 and 106*a* formed on the side plates 14 and 14*a* by brackets 108 and 108*a* welded or otherwise secured thereto. The arms 36 and 36*a* are retained in the hinges 106 and 106*a* by any suitable fastener device, such as the bolt 110 shown in FIG. 6. Thus, these lower lever arms 36 and 36*a*, and their parallel construction with the upper lever arms 34 and 34*a*, permit the elevation of the desk top 12 to be adjusted without changing its angular position. Furthermore, the lower lever arms 36 and 36*a* strengthen and support the desk top 12 throughout a wide range of angular and elevational positions.

The opposite ends of the brackets 108 and 108*a* which form the hinges 106 and 106*a* for the lower lever arms 36 and 36*a* are bent inwardly to form stops or rests 112 and 112*a*. These rests 112 and 112*a* prevent the desk top 12 from rotating past the vertical position shown in FIG. 3, thus preventing any harm or injury to a user of the desk. That is, the rear edges 114 and 114*a* of the support plates 28 and 28*a* contact the rests 112 and 112*a* and prevent the desk top's rearward rotational movement beyond the vertical position. Thus, this is an important feature for the protection of the handicapped or disabled person using the present desk, since such persons are often unable to hold or support the desk top 12 during adjustment of its angular position.

Torsion Bar

The cross sectional views of FIGS. 7 and 8 illustrate the manner in which the torsion bar 40 is mounted in the hollow tube 38 between the upper lever arms 34 and 34*a*. The right end 116 of the torsion bar 40, shown in FIG. 7, is journaled in the upright member 26 but is rigidly connected to the upper lever arm 34. The left end 116*a* of the torsion bar 40, as shown in FIG. 8, is journaled through the upper lever arm 34*a* and rigidly connected to the upright member 26*a*. As described below, this construction permits the tongue of the torsion bar 40 to be transferred to the upper lever arms 34 and 34*a* for facilitating elevational adjustments of the desk top 12.

Referring first to FIG. 7, the torsion bar 40 is shown extending through a bearing 118 inserted in an opening in the interior surface 120 of the upright member 26. This bearing 118 is circular in cross section and has a circular opening large enough to accomodate the torsion bar 40, which is hexagonal in cross section, so that it can rotate relative to the upright member 26. A plug 122 is fixedly connected to lever arm 34 and is provided with a hexagonal opening of the same dimensions as the torsion bar 40. The plug 122 and bearing 118 are preferably constructed from steel, although other materials are also suitable. The plug 122 is also hexagonal in cross section and sized to correspond to the hexagonal opening 124, shown in FIG. 6, in the upper lever arm 34. Thus, the plug 122 serves to rigidly connect the right end 116 of the torsion bar 40 to the upper lever arm 34 while permitting it to freely rotate in the upright 26.

In contrast to the right end mounting of the torsion bar, the left end 116*a* extends through a bearing 119 (see FIG. 8) inserted in the upper lever arm 34*a* to permit free rotation of the torsion bar 40 relative thereto. A hexagonal plug 122a is inserted into a hexagonal opening in the upright member 26a. The hexagonal opening of the plug 122a receives the torsion bar 40 to rigidly connect its left end 116a to the upright member 26a and prevent any movement of one relative to the other. To provide extra retention of the torsion bar 40 relative to the upright member, an L-shaped bracket 124 can be inserted into the upright member 26a and attached to the torsion bar 40 by any suitable fastening means (not shown).

During assembly of the torsion bar 40 to the upright members 26 and the upper lever arms 34, the right end 116 is rotated a predetermined amount relative to the left end 116a in the direction indicated by the arrow in FIG. 7. Thus, the torsional force or torque produced by the rotated torsion bar 40 will act in the opposite direction. Furthermore, since the right end 116 of the torque bar is fixedly connected to the right upper lever arm 34, this torsional force will be transferred to the lever arm 34, thereby facilitating upward elevational adjustments in the desk top 12. That is, the upward rotation of the frame 44 is encouraged and assisted by the torsional force of the torsion bar 40 acting through the right lever arm 34. Thus, the elevation of the desk top 12 can be increased by applying only a slight upward force.

Moreover, the torsion bar 40 also serves as a spring suspension system to facilitate both upward and downward elevational adjustments. It may thus be torqued by an amount sufficient to cause the downward force of gravity exerted on the desk top 12 to be approximately balanced by the upward rotational force of the torsion bar 40 and other forces. That is, with the interlocking discs 98 disengaged, the resistive force of the frictional washers 102 and the torsional force of the torsion bar 40 substantially prevent the desk top 12 from rotating to its lowest elevational position. Rather, the desk top 12 remains in place and can either be raised or lowered very easily with only light, fingertip pressure. If upward adjustments are desired, they are particularly facilitated by the torsion bar 40.

Thus, the torsion bar 40 utilized in the present invention greatly reduces the physical force and strength required to adjust the height of the desk top 12 and makes the desk especially suited for handicapped and disabled persons. Furthermore, the end mountings of the torsion bar can be reversed, if desired, and its cross sectional shape may be other than hexagonal.

Safety Devices

FIG. 9 illustrates two safety features of the present invention. The interior surfaces of 120 and 120a of both of the upright members 26 and 26a are provided with stop devices 126 against which the lower lever arms 36 and 36a rest. The left stop device 126a is shown in FIG. 9. These stop devices 126 prevent arms 34 and 34a from traveling below a horizontal position. As a result, the desk top 12 is prevented from moving below a predetermined horizontal position and possibly injuring a handicapped or other person utilizing the desk.

Furthermore, the upper edges of the lower lever arms 36 and 36a are provided with tabs 128 (only one of which is shown in FIG. 9). In adjusting the elevation of the desk top 12 upwardly, as shown in FIG. 2, the tabs 128 will contact the lower edges of the upper lever arms 34 and 34a thereby preventing the parallel lever arms 18 and 18a from coming completely together and possibly pinching one's fingers or otherwise injuring a person utilizing the desk. These stop devices 126 and tabs 128, together with the rests 112 shown in FIG. 6 (which prevent movement of the desk top 12 beyond the vertical position), are important safety features when the desk of the present invention is being utilized by handicapped persons since they generally lack the physical strength necessary to control the angle and height of the desk top 12 as it is being adjusted.

We claim:

1. A desk for use by a handicapped or disabled person, comprising:

a desk top for supporting books, paper and the like;

a base for supporting said desk top, said base being dimensioned and constructed without obstructions so that it will accomodate a wheel chair, and the like, which may be used by said handicapped or disabled person;

lever arm means for attaching said desk top to said base and permitting the adjustability of the height of said desk top, said lever arm means including:

torsional means for facilitating said adjustment of the height of said desk top by said handicapped or disabled person;

first locking means for selectively fixing the height of said desk top when said locking means is unlocked and permitting adjustments in the height of said desk top when said locking means is unlocked; and first frictional means for assisting said torsional means in maintaining the height of said desk top when said locking means is unlocked to further facilitate said adjustment in the height of said desk top by said handicapped or disabled person;

means for mounting said desk top on said lever arm means and permitting adjustability of the angle of said desk top independent of the adjustment of the height of said desk top, said mounting means comprising:

second locking means for selectively fixing the angle of said desk top when said locking means is locked and for permitting adjustments in the angle of said desk top when said locking means is unlocked; and second frictional means for maintaining the angle of said desk top when said locking means is unlocked to further facilitate the adjustment of said desk top by said handicapped or disabled person.

2. The desk of claim 1 wherein said torsional means comprises a torsion bar for aiding said handicapped or disabled person in increasing the height of said desk top and maintaining the height of said desk top when said first locking means is unlocked.

3. The desk of claim 1 wherein said first and second locking means comprises a pair of interlocking discs which are easily locked and unlocked by said handicapped or disabled person with a minimum of manual dexterity.

4. The desk of claim 1 wherein said desk top further comprises means for preventing said books, papers and the like from falling off of said desk top.

5. The desk of claim 4 wherein said prevention means comprises removable clamp means for holding said books, papers and the like on said desk top, said clamp means being attachable to said desk top at least in two locations on said desk top.

6. The desk of claim 5 wherein said prevention means further comprises a raised lip extending substantially completely around the periphery of said desk top.

7. The desk of claim 1 wherein said base is sufficiently sturdy to prevent the tipping or falling of said desk, regardless of the position of said desk top, when said desk is incidentally contacted by said handicapped or disabled person in said wheel chair, and the like.

8. A desk for use by a person of less than average physical strength, comprising:

a desk top;

a base for supporting said desk top;

first means for mounting said desk top on said base to permit the adjustability of the height of said desk top, said first mounting means comprising means for facilitating said height adjustment of said desk top by said person of less than average strength;

second means for mounting said desk top on said base to permit the adjustment of the angle of said desk top, said first and second mounting means each comprising:

locking means for fixing the position of said desk top when said locking means is locked and for permitting adjustment in the position of said desk top when said locking means is unlocked; and frictional holding means for substantially maintaining the position of said desk top when said locking means is unlocked to further facilitate said adjustment in the position of said desk top by said person of less than average physical strength.

9. The desk of claim 8 wherein said first mounting means comprises parallel lever arm means for permitting changes in the height of said desk top without changing the angle of said desk top.

10. The desk of claim 8 further comprising retractable clamp means for holding books, papers and the like on said desk top.

11. A desk for use by a handicapped person having less than average physical strength and manual dexterity, comprising:

a desk top for supporting books, paper and the like;

a pair of side plates, one of said side plates located on either side of said desk top;

first means for rotatably mounting said desk top on said side plates to permit adjustments in the angle of said desk top;

a base for supporting said desk top, said base being dimensioned and constructed to provide sufficient clearance beneath said desk top to accomodate a wheel chair or other supportive seating device that may be used by said handicapped person;

two pair of substantially parallel lever arms providing means for adjusting the height of said desk top without changing its angular position, one of said pair located on either side of said desk top, each said lever arm attached at one end to one of said side plates and attached to its opposite end to said base;

second means for rotatively mounting said one end of said lever arms to said side plates, said first and second mounting means each comprising:

a pair of interlocking discs;

operating means for manually selectively (i) engaging said interlocking discs to prevent rotating of one of said interlocking discs relative to the other and securely fix the position of said desk top, and (ii) disengaging said interlocking discs to permit adjustments in the position of said desk top;

means biasing said interlocking discs to facilitate disengagement of said interlocking disc by said operating means; and at least one pair of frictional washers to provide means for substantially maintaining the position of said desk top when said interlocking discs are disengaged to facilitate adjustment in the position of said desk top by said handicapped person;

third means for rotatively mounting said opposite end of said lever arms on said base, said third mounting means including a torsion bar to provide means for further facilitating said adjustments in the height of said desk top, said torsion bar and said fictional washers substantially equalizing the force of gravity acting on said desk top to maintain said desk top in position when said locking discs are disengaged.

12. The desk of claim 11 wherein said operating means comprises a handle capable of engaging or disengaging said interlocking discs with only a few turns, said handle of said first mounting means and said handle of said second mounting means being located close to one another and within easy accessability by said handicapped person.

13. An adjustable desk wherein the position of the working surface of said desk can be adjusted to suit the needs and desires of the user of said desk, comprising:

a base;

a desk top supporting said working surface;

first means for mounting said desk top on said base to provide adjustability of the elevational position of said desk top relative to said base, said mounting means comprising:

torsional means for facilitating the adjustment of the position of said desk top by biasing said mounting means;

first locking means for selectively (i) fixing the position of said desk top when said locking means is locked, and (ii) permitting adjustments in the position of said desk top when said locking means is unlocked; and holding means cooperating with said torsional means for substantially maintaining the position of said desk top when said locking means is unlocked.

14. The desk of claim 13 wherein said locking means comprises a pair of interlocking members having adjacent serrated surfaces to prevent rotation of one said member relative to the other.

15. The desk of claim 14 wherein said interlocking members are biased to facilitate said disengagement and adjustments of the position of said desk top.

16. The desk of claim 13 wherein said holding means comprises frictional means for inhibiting the movement of said desk top to substantially maintain its position when said locking means is disengaged thereby facilitating adjustment in the position of said desk top.

17. An adjustable desk adopted for use by users who may from time to time need to vary the position of the upper surface of said desk comprising:

a base;

a desk top supporting said upper surface;

means rotatively mounting said desk on said base to permit the rotational adjustability of the position of said desk top about an axis;

locking means for selectively locking the position of said desk top or unlocking said desk top to permit adjustment in the position of said desk top; and means for frictionally substantially maintaining the position of said desk top when said locking means are unlocked.

18. The adjustable desk of claim 17 wherein said locking means comprises a pair of juxtaposed interlocking discs for (i) preventing rotation of said desk top relative to said mounting means to fix the position of said desk top when said discs are engaged, and (ii) allowing the rotation of said desk top relative to said mounting means to permit the adjustment of the position of said desk top when said discs are disengaged.

19. The desk of claim 18 wherein the adjacent mating surfaces of said interlocking discs are serrated.

20. The desk of claim 17 wherein means for maintaining the position of said desk top comprises frictional means for inhibiting the rotation of said desk top relative to said mounting means.

21. The desk of claim 20 wherein said interlocking discs and said frictional means are both mounted on said axis, said interlocking discs being biased to facilitate said disengagement, said biased disengagement enhancing the operation of said frictional means to substantially maintain the position of said desk top when said interlocking discs are disengaged.

22. An adjustable desk, comprising;

a desk top;

means for mounting said desk top on said desk to permit the adjustment of the position of said desk top relative to said desk;

locking means coupled to said mounting means for fixing the position of said desk top when said locking means are locked and for permitting adjustment in the position of said desk top when said locking means are unlocked, said locking means being biased to facilitate said unlocking;

holding means connected to said mounting means for substantially maintaining the position of said desk top when said locking means are unlocked, said maintaining action of said holding means being assisted by said biasing of said locking means.

23. The adjustable desk of claim 13 wherein said holding means comprises first means for frictionally resisting the movement of said desk top when said locking means is unlocked to further facilitate adjustment of the elevation of said desk top.

24. The adjustable desk of claim 13 further comprising:

second means for rotatively mounting said desk top on said base to permit adjustment of the angular position of said desk top;

second locking means for selectively (i) fixing the position of said desk top when said locking means is locked, and (ii) permitting adjustment in the position of said desk top when said locking means unlocked; and means for resisting the rotation of said desk top when said locking means is unlocked to moveably substantially maintain the position of said desk top thereby facilitating its angular adjustment.

25. The adjustable desk of claim 24 wherein said second locking means comprises means for facilitating the unlocking of said locking means, said facilitating means increasing the resistance provided by said resisting means.

* * * * *